United States Patent [19]

Latta et al.

[11] 4,080,038

[45] Mar. 21, 1978

[54] NON-BULGING QUICK SNAP-ON STRAIN RELIEF ADAPTER

[75] Inventors: Jean C. Latta, Chicago; Frederick J. Radloff, Northlake, both of Ill.

[73] Assignee: Bunker Ramo Corporation, Oak Brook, Ill.

[21] Appl. No.: 791,769

[22] Filed: Apr. 28, 1977

[51] Int. Cl.[2] ..... H01R 13/58

[52] U.S. Cl. ..... 339/103 M; 339/44 M; 339/76; 339/107; 339/209

[58] Field of Search ..... 339/103 R, 103 M, 75 M, 339/76, 44 R, 44 M, 107, 209; 29/630 R

[56] References Cited

U.S. PATENT DOCUMENTS

| | | | |
|---|---|---|---|
| 3,336,565 | 8/1967 | Crimmins | 339/107 |
| 3,638,169 | 1/1972 | Caveney et al. | 339/107 |
| 3,920,306 | 11/1975 | Barnett, Jr. et al. | 339/107 |
| 3,958,853 | 5/1976 | Wilson | 339/209 |
| 3,959,868 | 6/1976 | Mathe | 29/630 R |

*Primary Examiner*—Roy Lake
*Assistant Examiner*—DeWalden W. Jones
*Attorney, Agent, or Firm*—William Lohff; F. M. Arbuckle

[57] ABSTRACT

A one-piece strain relief adapter is mounted on the rear end of an elongate electrical connector and carries pressure members for pressing against insulated conductors which have been inserted into insulation-opening contact portions of respective electrical contacts. The strain relief adapter carries a plurality of hook-shaped elements for positively aligning the pressure members with the conductors and for preventing ride-up of the adapter when these elements engage a forward facing surface of the electrical connector. The adapter also includes a yieldable resilient latch mechanism, preferably centered with respect to its ends, to engage a shoulder at the rear end of the electrical connector for holding the adapter to the electrical connector and for preventing bulging at the center of the adapter. The adapter also has a recess for slidingly receiving an internal rib of a hood and a forwardly facing surface which engages the internal rib to prevent removal of the hood in the rearward direction.

33 Claims, 9 Drawing Figures

Fig. 1
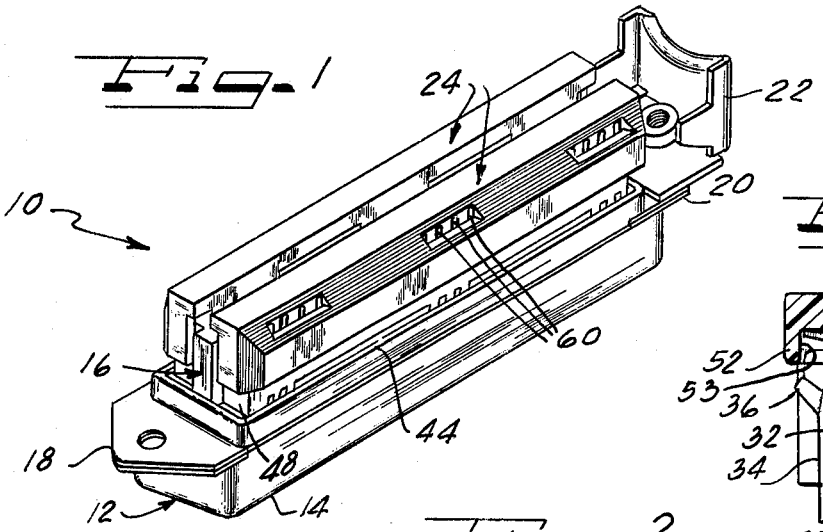
Fig. 4
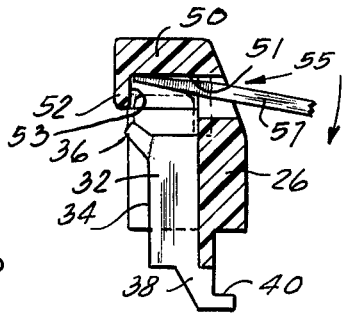
Fig. 2
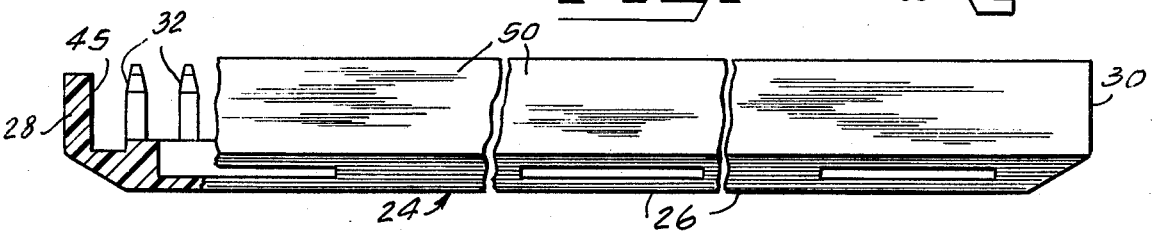
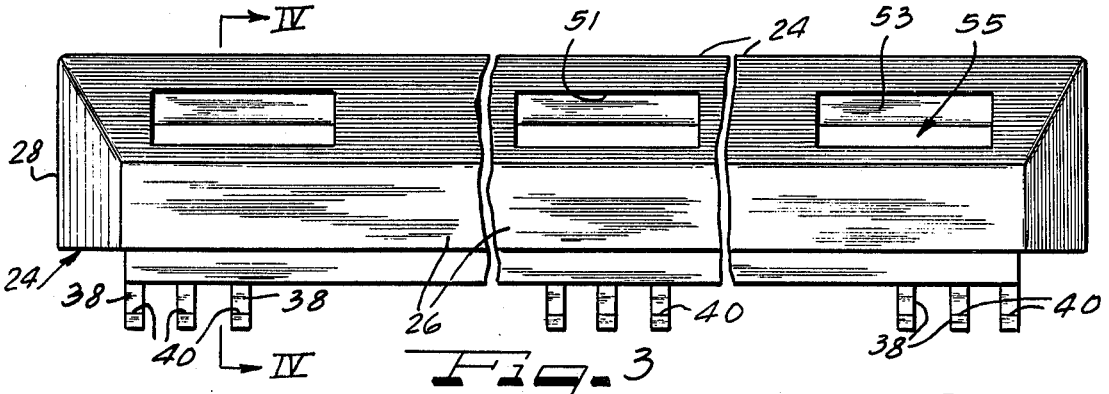
Fig. 3
Fig. 5
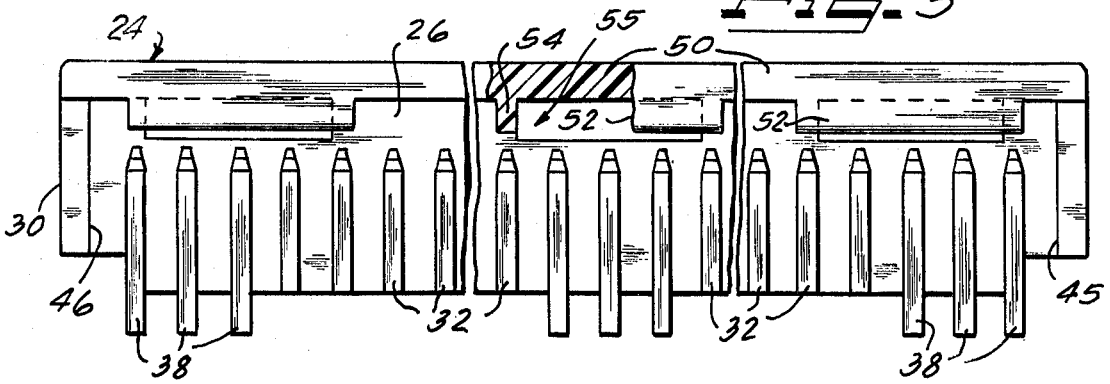

NON-BULGING QUICK SNAP-ON STRAIN RELIEF ADAPTER

BACKGROUND OF THE INVENTION

1. Field of the Invention

This invention relates to a strain relief adapter for an electrical connector, and is more particularly concerned with a non-bulging quick snap-on strain relief adapter for an elongate electrical connector.

2. Description of the Prior Art

In the past, strain relief for conductors which are connected to electrical contacts has been provided by a variety of structures. A tortious conductor path, for example, may be utilized to provide strain relief for flat multi-conductor cables, such as disclosed by D. J. Crimmins in U.S. Pat. No. 3,336,565.

For multi-conductor cables of circular cross section, a variety of strain relief clamps have heretofore been disclosed. One such strain relief clamp is disclosed by J. E. Caveney and Roy A. Moody in U.S. Pat. No. 3,638,169.

Although elongate electrical connectors may employ a strain relief clamp for the entire cable, the elongate structure of the connector requires removal of the outer protective jacket material of a cable so that the individual insulated conductors may extend individually to and be connected to respective contacts of the electrical connector, which contacts are usually aligned, spaced apart in rows on opposite sides of the electrical connector. In elongate electrical connectors of the type which employ insulation-opening contacts, it is highly desirable to provide strain relief for each of the individual conductors in order to prevent accidental and inadvertent dislodging of the conductors from the contacts. A strain relief adapter for use with an elongate electrical connector is disclosed by Istvan Mathe in his U.S. Pat. No. 3,959,868. This adapter includes an elongate member which carries a plurality of transversely extending members which engage and press against the individual conductors as the same are held in respective insulation-opening contact portions on one side of an electrical connector. A similarly constructed member provides strain relief for the opposite side of the electrical connector. Each of the strain relief adapters includes a pair of arms located at opposite ends of the elongate member which are hook-shaped and embrace the rear end of the electrical connector for anchoring the adapters to the connector. Also, each of the elongate members includes a transversely extending, notched member which receives the individual conductors in the notches and urges the conductors into the strain relief mechanism normally carried by the electrical connector so as to provide an additional strain relief for the conductors.

In his allowed patent application Ser. No. 679,091, Istvan Mathe discloses a similar elongate member in which the means for anchoring a pair of elongate members on opposite sides of an electrical connector includes a hook-shaped arm at one end of the member which is received in a recess of the other elongate member.

In U.S. Pat. No. 3,958,853, R. E. Wilson discloses an elongate member which carries a plurality of individual projections which bear against the individual conductors which are carried in insulation-piercing contacts of an electrical connector. The electrical connector has a pair of slots at each end thereof and each of the elongate members is provided with a flip-shaped element at each end for engaging respective slots at opposite ends of the connector.

In U.S. Pat. No. 3,920,306 M. E. Barnett Jr., G. H. Foster Jr. and G. A. Patton disclose the utilization of a pair of clamping bars on opposite sides of an electrical connector. The clamping bars each include a recessed arm at one end and a projection at the other end for interengagement with like structure of the other clamping bar. Each of the clamping bars also includes a transversely extending hook-shaped member and a rearwardly extending projection carried on the rear surface of the clamping bar. The hook-shaped member extends across the rear end of the connector to engage the projection of the other clamping bar.

SUMMARY OF THE INVENTION

Although various strain relief structures are known in the art, as noted by the examples referenced above, a number of problems have been encountered and have been solved, and advantages heretofore unknown have been realized, according to the primary object of the present invention, by providing a new and improved strain relief adapter.

One object of the invention is to provide a strain relief adapter of the type generally set forth above in which the end latches have been eliminated so that the adapter may fit in a standard right angle hood generally used with the elongate electrical connector.

Another object of the invention is to provide for a positive alignment between the adapter and the connector insert in order to shorten field assembly time.

Another object of the invention is to provide a strain relief adapter with a structure which positively controls ride-up of the adapter under force, that is displacement of the adapter in the rearward direction of the connector.

Another object of the invention is to provide a strain relief adapter which will hold insulation-opened conductors positively between the insulation-opening jaws and control bulging out, i.e. bending out of the adapter at the center, when an adapter is assembled to an electrical connector.

According to the invention, a strain relief adapter is provided for an electrical connector of the type which includes an elongate dielectric rear member, a plurality of insulation-opening contact portions which are supported spaced apart by the dielectric rear member for receiving respective insulated conductors, and a front member which is connected to the rear member and adapted to mate with another electrical connector, the adapter comprising an elongate member, pressure means in the form of a plurality of spaced apart blades carried by the elongate member for pressing against the conductors to urge the conductors into the insulation-opening contact portions, and anchoring means for securing the elongate member to the connector, the anchoring means being in the form of a plurality of spaced hook-shaped members which engage a flange near the juncture of the front member and rear member and a plurality of spaced apart hook-shaped members which engage a shoulder formed in the rear surface of the dielectric rear member.

More specifically, a strain relief adapter for an electrical connector of the type generally mentioned above comprises a pair of elongate members for engagement with respective sides of the dielectric rear member, each of the elongate members including a forward edge and a rear edge, referenced to the front and rear of the connector, pressure members between the forward edge and rear edge for engaging and pressing against the conductors in the insulation-opening contact portions, a plurality of hooks for engaging a respective flange on the respective side of the electrical connector and constituting a pivot for rotating the elongate member toward the rear member and at least one latch surface for engaging at least one shoulder in an elongate groove in the rear surface of the elongate dielectric rear member of the electrical connector.

In one embodiment of the invention the latch surface is constituted by a plurality of forward extending projections which extend from a transversely directed member carried by the elongate member. In this embodiment, the projections extend forward in an area between the blade-shaped pressure members over the entire extent of the elongate member.

In another embodiment of the invention, the latch surface is formed by a plurality of spaced forwardly extending projections, similar in structure to the projections mentioned above, but being fewer in number and terminated at each end so as to form pockets, each of which pockets surround a group of barriers which extend transversely of the dielectric rear member forming channels in which the insulation-opening contacts are mounted.

In another embodiment, a pair of projections extend transversely from the elongate member and carry a cross member at the distal ends thereof, the projecting members and the cross member forming an opening for receiving the end of a barrier therein.

BRIEF DESCRIPTION OF THE DRAWINGS

Other objects, features and advantages of the invention, its organization, construction and operation will be best understood from the following detailed description taken in conjunction with the accompanying drawings, on which:

FIG. 1 is a pictorial representation of an elongate electrical connector with the protective hood removed and with a pair of strain relief adapters constructed according to the present invention mounted thereon;

FIG. 2 is a top plan view of one of the strain relief adapters of FIG. 1, shown partially in section;

FIG. 3 is a side elevation view of the strain relief adapter;

FIG. 4 is a sectional view of the strain relief adapter taken generally along the line IV—IV of FIG. 3;

FIG. 5 is a side elevation of the strain relief adapter showing the side opposite to that illustrated in FIG. 3;

DESCRIPTION OF THE PREFERRED EMBODIMENTS

Figure 7:
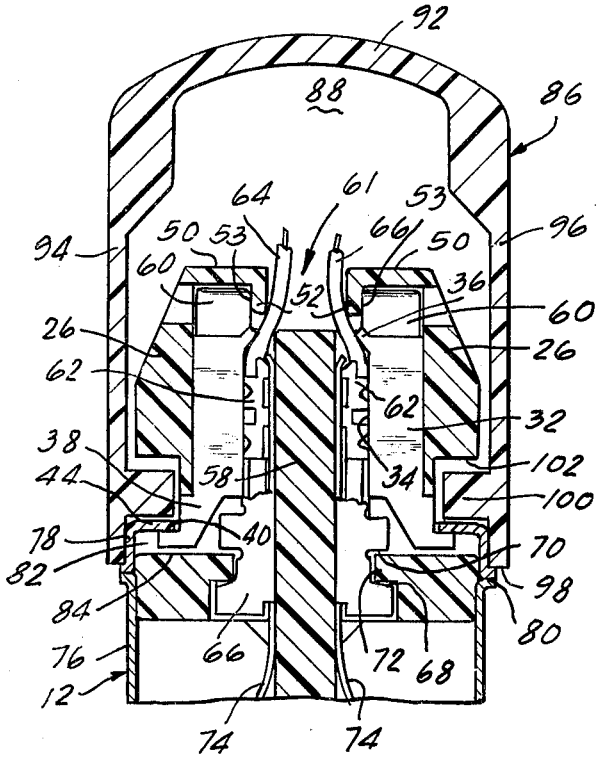
FIG. 7 is a transverse section of an elongate electrical connector with a protective hood thereon and the strain relief adapters of FIGS. 1–5 mounted thereon, showing the relationships between the connector, the insulation-opening contacts of the connector, the insulated conductors and the strain relief adapters and the relationships between the connector, the strain relief adapters and the protective hood.

Referring to FIG. 1, an elongate electrical connector having a pair of strain relief adapters mounted thereon is generally illustrated at 10 as comprising a forward end 12 having a hollow front housing 14 which is adapted to mate with a complementary electrical connector, and a rear member 16 which supports a plurality of insulation-opening contacts, such as found on the Amphenol Connector designated 157-82500-3. The connector 12 includes an end flange 18 at one end thereof and an end flange 20 at the other end thereof which supports a cable strain relief structure 22. A pair of strain relief adapters 24 is mounted on the rear end 16 of the electrical connector. As illustrated, the electrical connector includes a pair of components, which may be formed sheet metal components, which are secured together to hold the dielectric insert which carries the rear member 16, one of which components includes a flange 44 which is directed inwardly of the connector.

Referring to FIGS. 2–5, each strain relief adapter 24 is illustrated as comprising an elongate member 26 having a transversely extending end member 28 at one end and a transversely extending end member 30 at the opposite end thereof. On one side, the inner side, the elongate member 26 has a pressure means in the form of a plurality of inwardly extending pressure members or pressure blades 32 which are spaced apart corresponding to the spacing of the insulation-opening contacts of the electrical connector. As best seen in FIGS. 4 and 7, each pressure member 32 has a forward surface for engaging and pressing against a conductor mounted in the respective contact and a projection 36 which deflects upon engagement with the respective conductor and presses the conductor further inwardly at a point adjacent the end of the terminating portion of the contact in a constricted-opening strain relief which is normally a part of the electrical connector. This construction of the electrical connector is best seen at reference 104 in FIG. 8.

As illustrated in FIGS. 3, 4, 5 and 7, some of the pressure members 32 may be provided with an extension 38 which carries a transversely extending projection 40 to form a hook-shaped member which engages beneath the longitudinally extending, inwardly directed flange 44. This structure provides several features. First of all, when the adapter is mounted in place, the projections 40 bear against the flange 44 to prevent an up-riding, that is a rearward movement, of the adapter, thereby resisting tensile forces on the conductors which could cause dislocation of the conductors. Secondly, a center bulging effect is obviated when such hooks are provided in the central portion of the adapter. This feature is also provided by the latching mechanism which is discussed below. Thirdly, the provision of such a hook at each end of the adapter corresponding to the positions of the end contacts, provides for easy positive alignment of the adapter and quick connection of the adapter to the rear end of the electrical connector.

Figure 8:
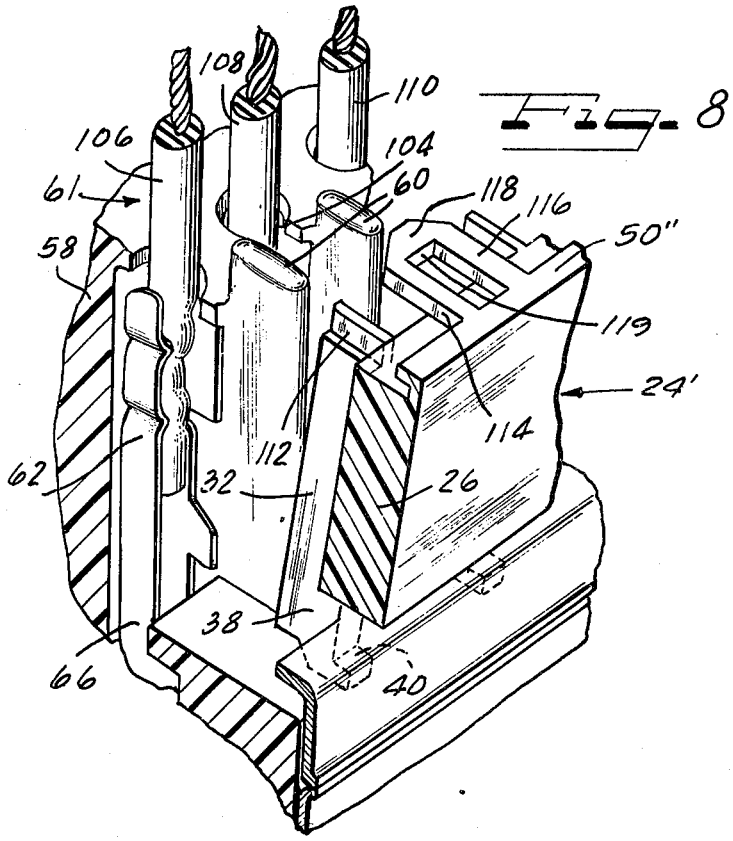
FIG. 8 is a fragmentary pictorial illustration of a portion of an elongate electrical connector with a strain relief adapter thereon, the strain relief adapter including portions of pressure members for extending into the strain relief of the connector and a latch construction which is different from that illustrated in FIGS. 5 and 6.

Referring for a moment to FIG. 8, the electrical connector is illustrated as comprising a plurality of protective barriers 60 with the electrical contacts disposed therebetween. In FIG. 1, the end barriers are illustrated as having a surface 48 which also aids in aligning the adapter on the connector. The adapter ends 28 and 30 carry respective inner surfaces 45 and 46 which slidingly engage the end surfaces of the barriers, such as at 48, to locate the end barriers between these surfaces and the adjacent pressure member 32. The end members 28 and 30 which extend from the elongate member 26, and a top transversely extending member 50 which joins the elongate and end members, and the one-piece molding of these members, along with the pressure blades as a single unit, provides rigidity for the adapter.

As is evident from the drawings, particularly FIGS. 1, 2, 5, 7 and 9, the disposition of the pressure member 32 in the contact channels and the engagement of the surfaces 45, 46 with the end surfaces of the barriers, as at 48, stabilizes the adapter in the longitudinal direction.

The top member 50 carries a plurality of projections 52 which extend in the forward direction of the connector. The projections 52, as best seen in FIG. 5, are also connected to the elongate member 26 by a pair of members 54 which extend forwardly from the top member 50 and transversely from elongate member 26 to form pockets which receive the ends of a plurality of the barriers 60 when the adapter 24 is rotated into its final mounted position. Each of the projections 52 therefore carries a latch surface 53 which engages the opposite facing surface of a plurality of the barriers 60. It should be noted that the barriers 60 extend above the end surface of the dielectric insert to form an elongate slot or groove 61 therein, and it is in this slot or groove 61 that the conductors enter the connector body for termination to the insulation-opening contacts. In order to facilitate removal of the adapter, a plurality of openings 55 are provided to receive a tool 57, such as a screwdriver (shown in phantom), which may be rotated, as indicated by the arrow, against a surface 51 of the top member 50 to lift the latch surface 53 out of engagement with the barriers 60.

The anti-bulge feature discussed above is also provided by the latch mechanism and it is therefore preferable that a latch projection 52 be provided in the central portion of the adapter 24.

Figure 6:
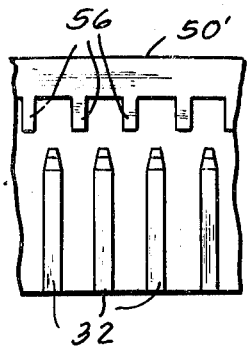
FIG. 6 is a side elevation view, similar to that of FIG. 5, showing a different latch mechanism for the strain relief adapter.

Another embodiment of a latch is illustrated in FIG. 6 in which the top member has been referenced 50', and which top member has a plurality of forwardly extending latch members 56 projecting therefrom and with a spacing corresponding to the spacing of the barriers 50. In this embodiment, each latch member 56 engages the oppositely facing surface of a respective barrier and the cross sectional view thereof is the same as illustrated in FIG. 4. The latch members 56 may be provided in spaced groups as in FIG. 5, or the same may be provided along the entire length of the adapter. Here again, it is preferred that the latch members be provided in the central portion of the adapter to prevent bulging at the rear end of the adapter, that is in the area of the top member 50'.

FIG. 7 is offered to place the foregoing in a better perspective and to illustrate the advantageous features with respect to the relationships between the connector, the adapter and the protective hood. As seen in FIG. 7, the dielectric insert 58 extends from the rear end of the connector to the forward end of the connector and carries, on each side thereof, a plurality of spaced apart barriers 60. An insulation-opening contact, such as the type disclosed in the aforementioned Mathe patent, is mounted between adjacent barriers and includes an insulation opening portion 62 which is electrically and mechanically connected to a respective conductor, conductors 64 and 66 being illustrated in FIG. 7. The insulation-opening contact also includes an intermediate portion 66 which has a rearward facing shoulder 68 and a forward facing shoulder 70 which engage opposite sides of a projection 72 of the insert to prevent movement of the contact in the rearward and forward directions, respectively. Each contact also includes an active portion 74 which extends into the forward portion of the connector for mating engagement with a complementary electrical connector. The forward end of the electrical connector has a first shell portion 76 and a second shell portion 78, each with engaging flange portions which extend outwardly of the connector and form a flange 80. The shell portion 78 carries the inwardly directed flange 44 which is spaced, as indicated at 82 from a rearwardly facing surface 84 of the dielectric insert. As mentioned above, the pressure member portion 38 and the transverse projection 40 engage the flange 44 and pivot thereabout as the adapter 24 is moved into its mounted position.

An important feature of the invention resides in the provision of an adapter which can be used with the protective hood normally provided with the electrical connector. In FIG. 7 a protective hood 86 includes a pair of spaced side walls 94 and 96, a top wall 92 and an end wall 90 which define a chamber 88 for receiving the rear end of the electrical connector with a pair of adapters mounted thereon. The end of the hood 86 which is opposite the end wall 90 is normally open to receive a cable therein, which cable is supported on the cable strain relief 22 in FIG. 1. The side walls 94 and 96 include a bottom edge 98 which slidingly engages and is supported by the flange 80 and the hood 86 is slid onto the rear end of the connector. Each of the sidewalls 94 and 96 also includes a transversely, inwardly extending rib 100 which is received between the flange 44 and a forwardly facing surface 102 which prevents removal of the hood in the rearward direction.

Figure 9:
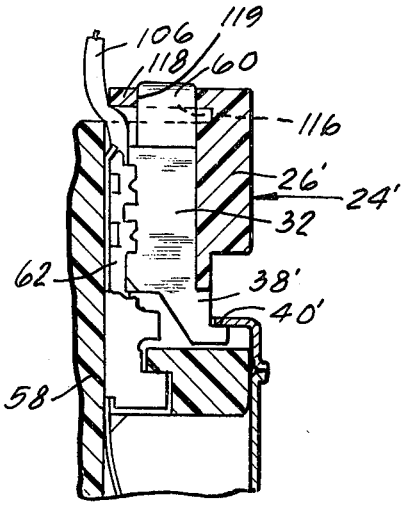

Referring to FIGS. 8 and 9, an enlarged and more detailed view of the rear end of the electrical connector is illustrated in conjunction with another embodiment of the invention. As seen in FIG. 8, the dielectric insert 58 is provided with a plurality of constricted openings 104 which form a strain relief mechanism for the connector even without the provision of a strain relief adapter. In FIG. 8 a plurality of conductors 106, 108 and 110 are illustrated as the same would be electrically and mechanically terminated in an insulation-opening contact portion 62. The strain relief adapter 24' illustrated in FIGS. 8 and 9 has substantially the same construction as the previously discussed strain relief adapters and corresponding parts have been given similar, but primed, reference characters. There are two major differences, however, which will be discussed herein. First of all, the projection 36 of the pressure member 32 does not exist. Instead, the pressure member 32 includes a narrowed portion 112 which enters the constricted opening 104 of the strain relief mechanism to press against the respective conductor. Secondly, the top member 50" includes at least one pair of transversely extending members 114 and 116 which have a cross member 118 at the distal ends thereof. The members 114, 116 and 118 form a recess for receiving the end of a barrier 60 therein and the cross member 118 carries a latch surface 119 for engaging the oppositely facing surface of the barrier 60, as illustrated in FIG. 9. Preferably, this latch is centrally located and, of course, a plurality of such latches may be provided on the strain relief adapter 24'.

Although the strain relief adapters constructed in accordance with the present invention are substantially rigid, the same are also reasonably flexible in the area of the latches to provide for releasable engagement of the latches. The desired rigidity with the desired flexibility can be provided by molding the adapter from a resilient plastic material, such as NORYL, SE-O 225.

In summary, the objects of the invention have been accomplished and adapter constructions have been provided which permit the utilization of a conventional right angle protective hood, which have positive alignment of the pressure members, which do not ride up and do not suffer from center bulging, and which do not have end latches, but releasably engageable rear latches which aid in preventing center bulging.

Although the invention has been described by particular illustrative embodiments thereof, many changes and modifications of the invention may become apparent to those skilled in the art without departing from the spirit and scope of the invention. It is therefore intended that the patent warranted hereon cover all such changes and modifications as may reasonably and properly be included within the scope of this contribution to the art.

I claim:

1. A strain relief adapter for an electrical connector which includes an elongate dielectric rear member, a plurality of insulation-opening contact portions supported spaced apart by the dielectric rear member for receiving respective insulated conductors, and a front member adapted to mate with another electrical connector, the front member connected to the rear member, said adapter comprising:

an elongate member;

pressure means carried by said elongate member for pressing against the conductors to urge the same into the insulation-opening contact portions; and anchoring means for securing the elongate member to the connector, said anchoring means including anti-bulge means for engaging the front and rear members and preventing bulging of the elongate member due to outwardly directed forces on the conductors.

2. The strain relief adapter of claim 1, wherein:

said pressure means includes a plurality of blades spaced according to the spacing of the insulation-opening contact portions, each of said blades including a forward end for engaging a respective conductor and a projection extending forward from said forward end to apply addition inwardly directed forces to the conductors.

3. A strain relief adapter for an electrical connector which includes an elongate dielectric rear member having a rear surface with a shoulder, a plurality of insulation-opening contact portions supported spaced apart by the rear member for receiving respective insulated conductors, a front member connected to the rear member and adapted to mate with another electrical connector, and a flange in the area of the juncture of the front and rear members, said adapter comprising:

an elongate member;

pressure means carried by said elongate member for pressing against and urging the conductors into the insulation-opening contact portions; and anchoring means for securing said elongate member to the electrical connector including first means for engaging the shoulder and second means for engaging the flange.

4. The strain relief adapter of claim 3, wherein: said second means includes hook means for engaging the flange.

5. The strain relief adapter of claim 3, wherein:

said second means includes a plurality of hooks spaced apart along said elongate member.

6. The strain relief adapter of claim 3, wherein:

said first means includes at least one latch extending from said elongate member and including a latch surface for engaging the shoulder on the rear surface of the rear member.

7. the strain relief adapter of claim 6, wherein:

said latch includes a first member extending from said elongate member and a second member extending from said first member and carrying said latch surface.

8. A strain relief adapter apparatus for an electrical connector of the type which includes an elongate dielectric rear member having a pair of oppositely facing sides and a rear surface, a plurality of outwardly and rearwardly opening L-shaped channels spaced apart in each of the sides and rear surface, an elongate groove in the rear surface communicating with the L-shaped channels, the channels and elongate groove defining rearwardly extending projections each having a shoulder in the groove, a plurality of insulation-opening contact portions supported in the channels to receive respective insulated conductors therein, a front member adapted to mate with another electrical connector, and a pair of flanges, one on each side, adjacent the L-shaped channels, said adapter apparatus comprising:

a pair of elongate members for engagement with respective sides of said rear member;

each of said elongate members including a forward edge and a rear edge, pressure means between said edges for engaging and pressing against the conductors in the contact portions, first means extending from said forward edge for engaging the respective flange to secure said forward edge to to the connector, and second means for engaging at least one of the shoulders in the groove to latch said rearward edge to the connector.

9. Strain relief adapter apparatus according to claim 8, wherein:

said first means comprises a plurality of hooks for engaging the respective flange and constituting a pivot for rotating said elongate member toward the rear member.

10. Strain relief apparatus according to claim 8, wherein:

said second means comprises at least one latch surface for engaging at least one shoulder in the groove.

11. Strain relief apparatus according to claim 10, wherein:

said second means comprises first and second members extending from said rear edge and a third member spaced from said rear edge and connected to said first and second members, said first, second and third members to receive and embrace at least one of the projections and said third member carrying said latch surface.

12. Strain relief apparatus according to claim 10, wherein:

said second means comprises at least one hook for extending over the rear surface and carrying said latch surface.

13. Strain relief apparatus according to claim 10, wherein:

said second means comprises a plurality of first members spaced apart and extending from said rear edge; and a plurality of second members each extending from a respective one of said first members and each carrying a latch surface.

14. In a strain relief adapter of the type in which an elongate member carries pressure members to bear against insulated conductors electrically contacted by insulation-opening contact portions, the contact portions being supported by a dielectric insert of an elongate electrical connector, and in which anchoring means secure the elongate member to the electrical connector, the improvement wherein the anchoring means comprises:

first means for engaging a first portion of the electrical connector to prevent rearward movement of the elongate member; and second means for engaging a second portion of the electrical connector to prevent lateral bulging of the elongate member.

15. The improved strain relief adapter of claim 14, wherein at least a portion of said second means is located centrally of the elongate member.

16. A strain relief adapter for an electrical connector which includes an elongate dielectric rear member, a plurality of insulation-opening contact portions supported spaced apart by the dielectric rear member for receiving respective insulated conductors, and a front member adapted to mate with another electrical connector, the front member connected to the rear member, said adapter comprising:

an elongate member;

pressure means carried by said elongate member for pressing against the conductors and urge the same into the insulation-opening contact portions; and anchoring means for securing said elongate member to the connector, said anchoring means including anti-bulge means for engaging the rear end of the connector to prevent an outward transverse bulging of said elongate member.

17. A strain relief adapter for an electrical connector which includes an elongate dielectric rear member, a plurality of insulation-opening contact portions supported spaced apart by the dielectric rear member for receiving respective insulated conductors, and a front member adapted to mate with another electrical connector, the front member connected to the rear member, said adapter comprising:

an elongate member;

pressure means carried by said elongate member for pressing against the conductors and urge the same into the insulation-opening contact portions; and anchoring means for securing said elongate member to the connector, said anchoring means including ride-up preventing means for engaging the connector to prevent movement of said elongate member in the rearward direction.

18. A strain relief adapter for an elongate electrical connector which has an elongate rear dielectric member at least one transverse facing surface in the rear dielectric member, ad forward facing surface and a plurality of insulation-opening contact portions supported by the rear dielectric member for receiving respective insulated conductors therein, said strain relief adapter comprising:

pressure means for engaging and pressing against the electrical conductors to urge the conductors in the contact portions;

elongate support means for supporting said pressure means against the conductors; and anchoring means for engaging the transverse and forward facing surfaces to secure said support means to the electrical connector.

19. The strain relief adapter of claim 18, wherein said anchoring means comprises:

at least one transversely extending member connected to said support means; and at least one forwardly directed projection extending from said transversely extending member and including a transversely outward facing latch surface for engaging the transverse facing surface of the rear dielectric member.

20. The strain relief adapter of claim 18, wherein said anchoring means comprises:

a pair of transversely extending members projecting from said support means; and a cross member connected to the distal ends of said transversely extending members and including a transversely outwardly facing latch surface for engaging the transverse facing surface of the rear dielectric member.

21. The strain relief adapter of claim 18, wherein the rear dielectric member includes a plurality of coplanar transversely facing surfaces, and said anchoring means comprises:

an elongate transversely extending member connected to said support means; and a plurality of forwardly directed projections extending from said elongate transversely extending member, each of said projections including a transversely outward facing latch surface for engaging a respective one of said coplanar surfaces.

22. The strain relief adapter of claim 21, wherein said projections are positioned for bearing against the respective conductors to urge the conductors against the rear dielectric member.

23. The strain relief adapter of claim 18, wherein:

said anchoring means includes latch means attached to a central portion of said support means for engaging the transverse facing surface to prevent an outward bulging of said support means.

24. The strain relief adapter of claim 18, wherein said anchoring means comprises:

pivot means connected to said support means for pivotally engaging the forward facing surface for rotational movement of said pressure means toward the contact portions.

25. The strain relief adapter of claim 24, wherein said pivot means includes hook means for engaging the forward facing surface.

26. The strain relief adapter of claim 18, wherein said anchoring means comprises:

a plurality of spaced apart hook-shaped members extend from said support means to engage the forward facing surface of the connector.

27. The strain relief adapter of claim 18, wherein said pressure means comprises:

a plurality of pressure members for engaging and pressing against respective ones of the conductors.

28. The strain relief adapter of claim 27, wherein said anchoring means comprises:

a plurality of hook-shaped members integral with and extending from respective pressure members to engage the forward facing surface of the electrical connector.

29. The strain relief adapter of claim 18, wherein the electrical connector has a barrier on each side of an insulation-opening contact portion adjacent the forward facing surface, and wherein said anchoring means comprises:

at least two hook-shaped members extending from said support means and spaced apart a distance corresponding to the distance between the end insulation-opening contact portions to be received between the respective adjacent barriers as a positive location relative the connector and to engage the forward facing surface.

30. Strain relieved electrical connection apparatus comprising an elongate electrical connector and a strain relief adapter mounted on said electrical connector, said connector including an elongate dielectric member, including a rear end, a plurality of insulation-opening contact portions supported in a row by said dielectric member for receiving and electrically contacting respective insulated conductor, a plurality of protective barriers extending transversely from said dielectric member with said contact portions between adjacent barriers, and an elongate forward facing surface adjacent said barriers, each of said barriers having a surface facing transversely of said dielectric member and coplanar with the other such barrier surfaces, said adapter including an elongate support member, a top member extending transversely from said support member, pressure members extending transversely from said support member to press against the insulated conductors and urge the same into the respective contact portions, rearward facing ride-up preventing projections extending from said support member to pivotally engage said elongate forward facing surface for rotational movement of said pressure members toward the conductors, and at least one resilient latch member extending from said support member in a yieldable interference relation to at least one of said barriers, said latch member including a latch surface facing opposite to and engaging at least one said coplanar surfaces.

31. In a strain relief adapter of the type which is adapted for mounting on the dielectric insert of an elongate electrical connector and includes a support member and pressure members on the support member for bearing against insulated conductors mounted in insulation-opening contact portions supported by the dielectric insert the improvement therein comprising:

means on the support member for pivotally coupling the adapter to one portion of the electrical connector, and means on the support member and spaced from the pivotal coupling means for releasably latching the adapter to a second portion of the electrical connector.

32. A strain relief adapter for an elongate electrical connector which has an elongate rear dielectric member, at least one transverse facing surface in the rear dielectric member, a forward facing surface and a plurality of insulation-opening contact portions supported by the rear dielectric member with respective insulated conductors therein, said strain relief adapter comprising: pressure means for engaging and pressing against the electrical conductors in the contact portions;

resilient elongate support means for supporting said pressure means against the conductors; and anchoring means for releaseably engaging the transverse and forward facing surfaces to secure said support means to the electrical connector, including at least one transversely extending member connected to said support means, at least one forwardly directed projection extending from said transversely extending member including a latch surface for engaging the transverse facing surface of the rear dielectric member, and surfaces defining an opening through said elongate support means for receiving a tool therethrough to engage said transversely extending member and rotate the same to carry the latch surface of said forwardly directed projection out of engagement with the transverse facing surface of the rear dielectric member.

33. Electrical connection apparatus, in combination comprising:

an elongate electrical connector including an elongate rear dielectric member having a rear end and a pair of transverse facing surfaces in said rear end, a pair of forwardly facing surfaces, and a plurality of insulation-opening contacts supported by said rear dielectric member on each side thereof for receiving respective insulated conductors therein;

a pair of strain relief adapters each on a respective side of said dielectric member and each including pressure means for pressing inwardly against the conductors, support means for supporting said pressure means, said support means including a forwardly facing surface parallel to the respective forwardly facing surface of said electrical connector defining a recess therebetween, and anchoring means connected to said support means for engaging a respective forwardly facing surface and a respective transverse facing surface of said electrical connector; and a hood including a pair of spaced sidewalls, each of said sidewalls including an inwardly extending rib to be slidingly received in a respective recess with said forwardly facing surfaces of said rear dielectric member engageable with said ribs to prevent removal of said hood in the rearward direction.

* * * * *